US009812813B1

(12) United States Patent
Sakamoto et al.

(10) Patent No.: US 9,812,813 B1
(45) Date of Patent: Nov. 7, 2017

(54) LEVER-TYPE CONNECTOR

(71) Applicant: YAZAKI CORPORATION, Minato-ku, Tokyo (JP)

(72) Inventors: Nobuyuki Sakamoto, Shizuoka (JP); Akihiro Tsuruta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/953,076

(22) Filed: Nov. 27, 2015

(30) Foreign Application Priority Data

Dec. 3, 2014 (JP) ..... 2014-244701

(51) Int. Cl.
*H01R 13/629* (2006.01)
*H01R 13/502* (2006.01)

(52) U.S. Cl.
CPC ..... *H01R 13/62955* (2013.01); *H01R 13/502* (2013.01); *H01R 13/62933* (2013.01); *H01R 13/62938* (2013.01)

(58) Field of Classification Search
CPC ..... H01R 13/62938; H01R 13/62955; H01R 13/62933
See application file for complete search history.

(56) References Cited

U.S. PATENT DOCUMENTS 5,230,635 A * 7/1993 Takenouchi ..... H01R 13/62938 439/153
5,344,194 A * 9/1994 Hatagishi ..... H01R 13/62933 285/26
5,603,624 A * 2/1997 Taguchi ..... H01R 13/62933 439/157
5,823,809 A * 10/1998 Wakata ..... H01R 13/5202 439/157
8,641,433 B2 * 2/2014 Uchida ..... H01R 13/62955 439/157

(Continued)

FOREIGN PATENT DOCUMENTS

JP 2007-018733 A 1/2007
JP 2008-146847 A 6/2008

(Continued)

OTHER PUBLICATIONS

Office Action dated Dec. 6, 2016 in a counterpart Japanese patent application.

*Primary Examiner* — Amy Cohen Johnson
*Assistant Examiner* — Oscar C Jimenez
(74) *Attorney, Agent, or Firm* — Metrolexis Law Group, PLLC

(57) ABSTRACT

A lever-type connector includes a first and second connector housing, and a lever rotatably provided on the first connector housing and which can fit or separate the first and second connector housing by a rotating operation. A flexible lock arm is provided on the first connector housing. A free end side of the lock arm includes a locking part whose rear end side is capable of locking so as to be hooked to the rear end part of a locking protrusion of the lever, and a release operation part capable of releasing a locking state of the rear end part of the locking protrusion and the rear end side of the locking part. The locking part and the release operation part are provided adjacent to each other. The release operation part is positioned below the lever at a time of locking between the locking part and the locking protrusion.

19 Claims, 7 Drawing Sheets

(56) References Cited

U.S. PATENT DOCUMENTS

| | | | | |
|---|---|---|---|---|
| 8,734,170 | B2 * | 5/2014 | Ikeda | H01R 13/62955 439/157 |
| 2009/0023317 | A1 * | 1/2009 | Mizoguchi | H01R 13/62955 439/157 |
| 2012/0034812 | A1 * | 2/2012 | Tanaka | H01R 13/62938 439/372 |
| 2012/0318645 | A1 * | 12/2012 | Kobayashi | H01H 9/0066 200/50.01 |
| 2014/0256169 | A1 * | 9/2014 | Suzuki | H01R 13/62955 439/312 |
| 2015/0004829 | A1 * | 1/2015 | Aoki | H01R 13/62938 439/372 |
| 2015/0111441 | A1 * | 4/2015 | Suzuki | H01R 13/4223 439/871 |
| 2016/0379778 | A1 * | 12/2016 | Ooishi | H01R 13/62938 200/51.09 |

FOREIGN PATENT DOCUMENTS

| | | | |
|---|---|---|---|
| JP | 2012-059598 | A | 3/2012 |
| JP | 2013-110054 | A | 6/2013 |

* cited by examiner

LEVER-TYPE CONNECTOR

CROSS REFERENCE TO RELATED APPLICATION

The present application is based on, and claims priority from Japanese Patent Application No. 2014-244701, filed Dec. 3, 2014, the disclosure of which is hereby incorporated by reference herein in its entirety.

BACKGROUND

Technical Field

The present application relates to a lever-type connector in which a counterpart connector is fitted or separated with low insertion force by rotating operation of a lever.

Related Art

As a conventional lever-type connector in which a counterpart connector is fitted or separated with low insertion force by this type of a lever that utilizes the principle of leverage, there is one disclosed in JP 2012-059598A as illustrated in FIGS. 1 to 3.

The conventional lever-type connector 1 includes a male-type connector 2 in which a plurality of male-type terminals (not illustrated) are accommodated, a female-type connector 5 in which a plurality of female-type terminals (not illustrated) are accommodated, and a cylindrical lever 7 having a generally-elliptical cross section that is rotatably supported by a support shaft 3 of the male-type connector 2.

Further, when cam pins 6 of the female-type connector 5 are engaged with cam groove holes 8 of the lever 7, and the male-type connector 2 and the female-type connector 5 are rotated with respect to the lever 7 in a direction as illustrated by arrow "a" of FIGS. 1 and 3A, the female-type connector 5 is fitted within a hood section 2*a* of the male-type connector 2 with low insertion force by the principle of leverage as illustrated in FIGS. 2 and 3B. This fitting state is locked by a vertical front face 9*b* of a front end part 9*a* of an engagement protrusion 9 provided at an upper front side of the lever 7 being engaged with a vertical rear face 4*b* of an engagement part 4*a* provided at a free end side of a flexible lock arm 4 that extends in a connector insertion direction at an upper part of the hood section 2*a* of the male-type connector 2.

Moreover, to release the fitting state of the male-type connector 2 and the female-type connector 5, the locking state of the engagement part 4*a* of the lock arm 4 and the engagement protrusion 9 of the lever 7 is released by a pressing operation downward of release operation parts 4*c* provided at both sides of the engagement part 4*a* on the free end side of the lock arm 4, and thereafter, when the male-type connector 2 and the female-type connector 5 are rotated with respect to the lever 7 in a reverse direction of arrow "a" illustrated in FIGS. 1 and 3A, the female-type connector 5 is separated from within the hood section 2*a* of the male-type connector 2 with low insertion force.

SUMMARY

In the conventional lever-type connector 1, the lock portion of the engagement part 4*a* of the lock arm 4 and the engagement protrusion 9 of the lever 7 has a structure in which, as illustrated in FIG. 3B, the vertical front face 9*b* of the front end part 9*a* of the engagement protrusion 9 of the lever 7 is engaged with the vertical rear face 4*b* at the rear end of the engagement part 4*a* of the lock arm 4. Therefore, locking was susceptible to disengagement when tensile force of electric wires connected to the plurality of female terminals (force in a separating direction as illustrated by arrow "b" of FIG. 3B) is applied to the female-type connector 5. Further, as illustrated in FIGS. 2 and 3B, since the release operation parts 4*c* provided at both sides of the engagement part 4*a* of the lock arm 4 are exposed outside from a cutout portion 7*a* at the upper part of the cylindrical lever 7, there was a possibility that the locking is released by the release operation parts 4*c* being operated unexpectedly.

Therefore, the present application was made in order to solve the above-described problem and it aims to provide a lever-type connector whose locking is difficult to be disengaged unexpectedly while attaining simplification and miniaturization of a lock portion.

The lever-type connector according to one aspect of the present application includes: a first connector housing; a second connector housing; a lever which is rotatably provided on the first connector housing and which can fit or separate the first connector housing and the second connector housing by a rotating operation; a flexible lock arm which is provided on the first connector housing and which extends in a fitting direction of the connector; a locking protrusion provided on the lever; a locking part which is provided on a free end side of the lock arm and whose rear end side is capable of locking so as to be hooked to a rear end part of the locking protrusion; and a release operation part which is provided adjacent to the locking part and which is positioned below the lever at a time of locking between the locking part and the locking protrusion, the release operation part being capable of releasing a locking state of the rear end part of the locking protrusion and the rear end side of the locking part.

With such a structure, it is possible to achieve simplification and miniaturization of a lock portion composed of the locking part of the lock arm and the locking protrusion of the lever. Moreover, since the release operation part of the lock arm is not exposed outside, locking is not released unexpectedly and it is possible to enhance locking retention.

A first locking slope that is inclined so as to act in a direction of more engagingly locking may be formed on the rear end side of the locking part, and a second locking slope that is inclined so as to act in a direction of more engagingly locking may be formed on the rear end part of the locking protrusion.

With such a structure, when tensile force of electric wires is applied to the first connector housing, the first locking slope and the second locking slope are acted in a direction of mutual locking, and the locking between the locking part and the locking protrusion becomes harder to be disengaged, and thus, it is possible to easily and reliably prevent disengagement of locking of the locking part.

A connecting bridge of a front U-shape may be provided on a fixed end side of the lock arm. The lock arm may be provided to extend in a side L-shape and in a plan U-shape from a lower face of a center connecting part of the connecting bridge. The locking part may be provided at a center on the free end side of the lock arm. The release operation part may be provided to be adjacent to both sides of the locking part.

With such a structure, it is possible to achieve simplification and miniaturization of the lock portion that is composed of the locking part of the lock arm and the locking protrusion of the lever, while when the lever is forcibly rotation-operated toward a lock releasing direction, biting between the locking part of the lock arm and the locking protrusion of the lever becomes larger and it is possible to reliably prevent disengagement of the locking.

DETAILED DESCRIPTION

Explanations will be made regarding a lever-type connector according to an embodiment based on FIGS. 4 to 10.

Figure 1:
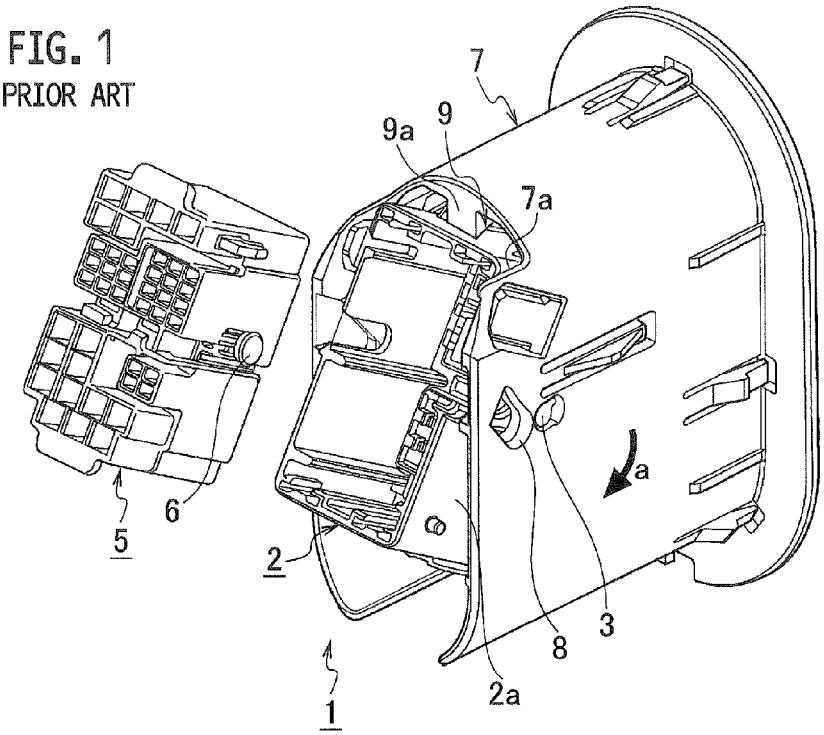
FIG. 1 PRIOR ART
FIG. 1 is a perspective view of a conventional lever-type connector illustrating a state before fitting.
Figure 2:
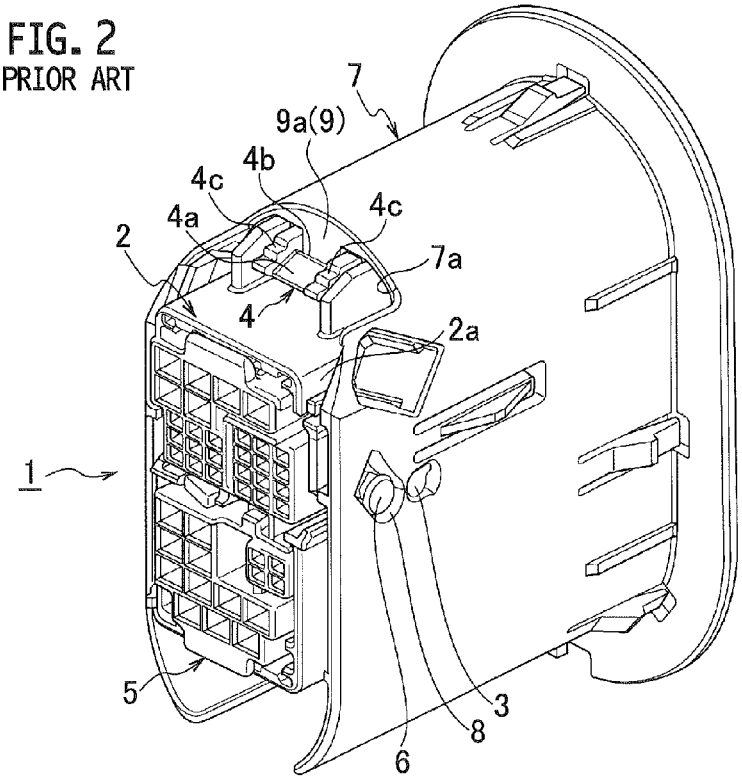
FIG. 2 PRIOR ART
FIG. 2 is a perspective view of the conventional lever-type connector illustrating a fitted state.
Figure 3A:
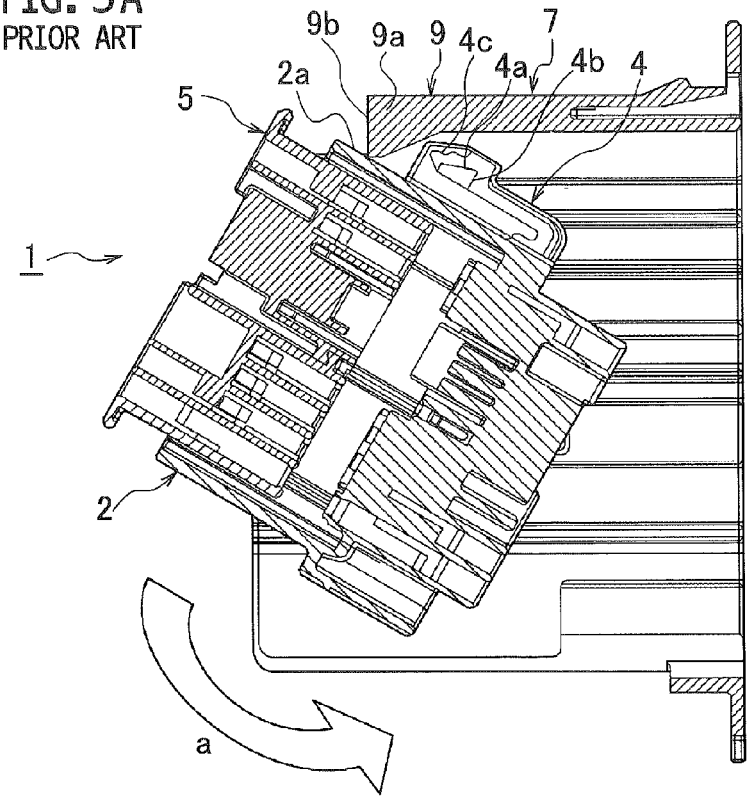
FIG. 3A PRIOR ART
FIG. 3A is a cross-sectional view of the conventional lever-type connector illustrating a state before fitting.
Figure 3B:
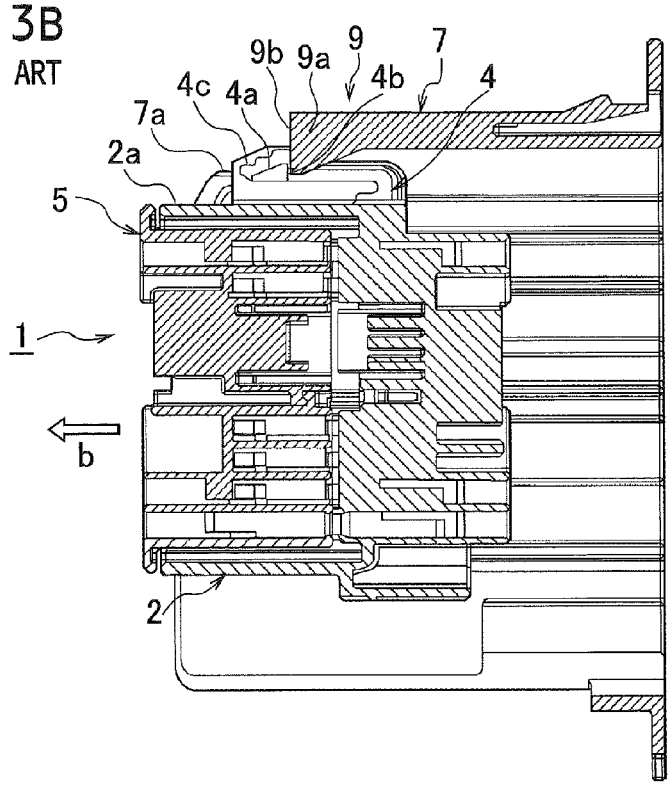
FIG. 3B PRIOR ART
FIG. 3B is a cross-sectional view of the conventional lever-type connector illustrating a fitted state.
Figure 4:
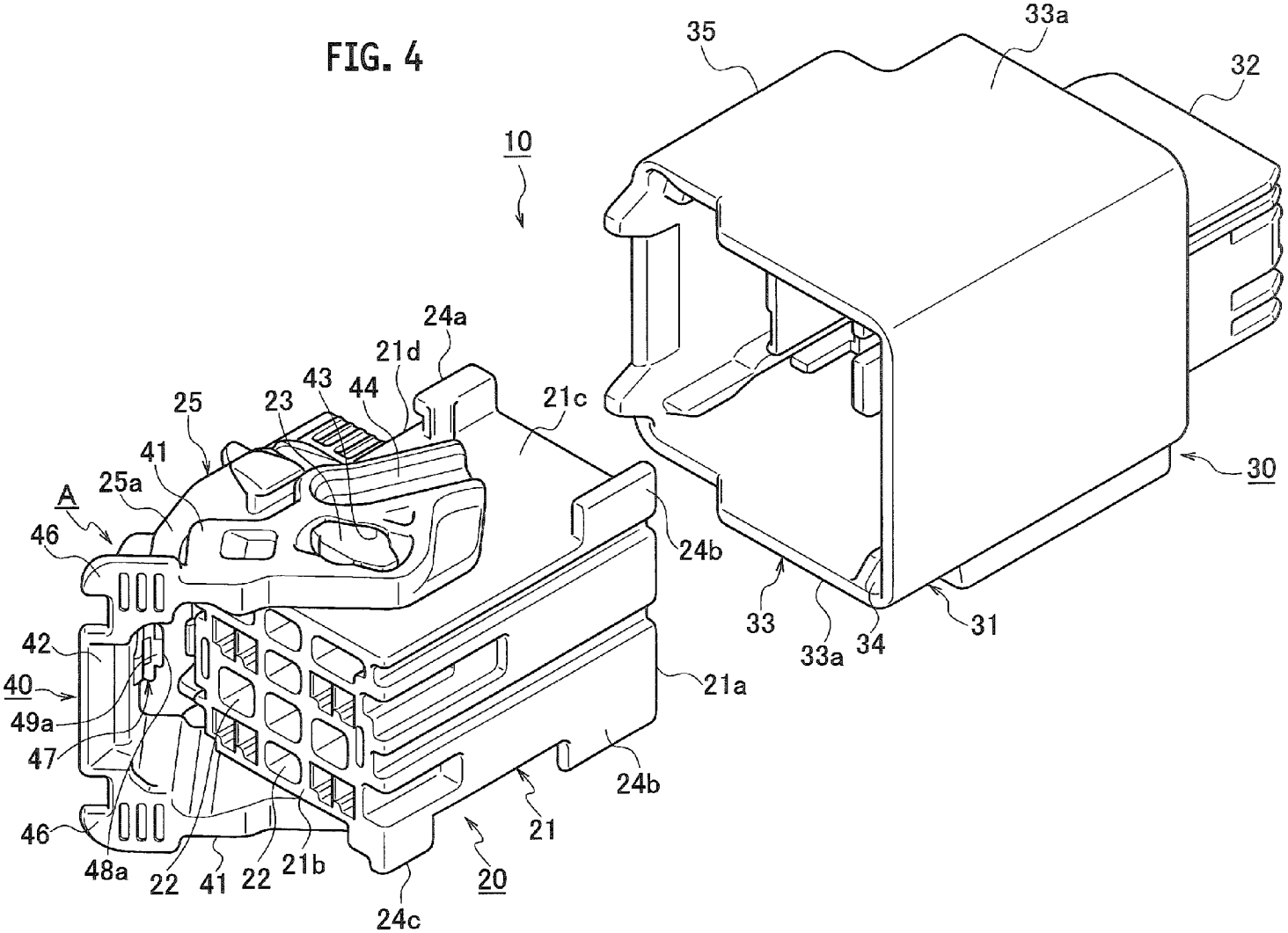
FIG. 4 is a perspective view of a lever-type connector according to an embodiment illustrating a state before fitting.
Figure 5:
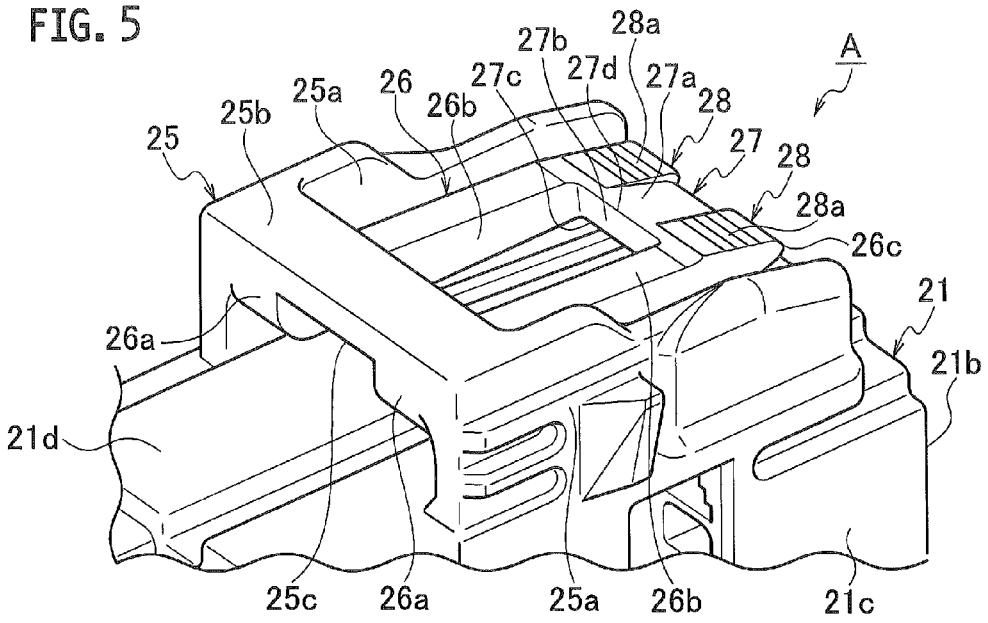
FIG. 5 is a partial perspective view of a main section of a first connector housing of the lever-type connector according to the embodiment.
Figure 6:
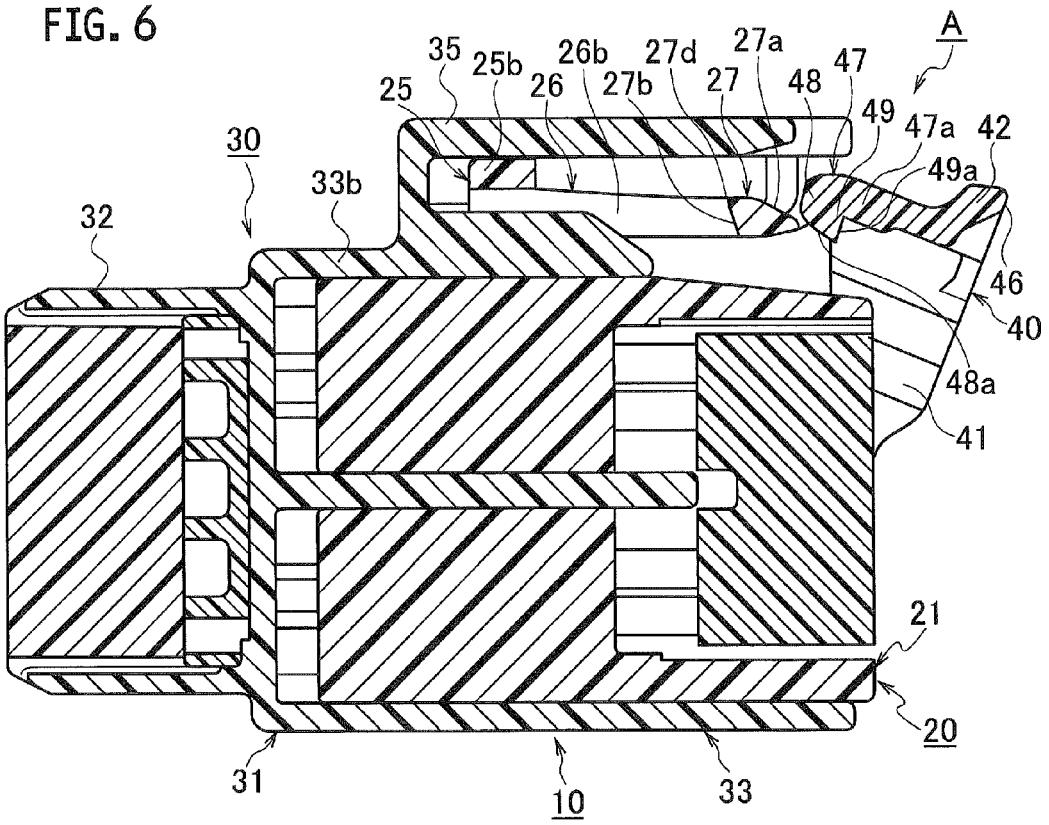
FIG. 6 is a cross-sectional view of the lever-type connector according to the embodiment illustrating a state before fitting.

As illustrated in FIGS. 4 to 6, a lever-type connector 10 according to an embodiment includes a female-type connector 20 in which female-type terminals (not illustrated) are respectively accommodated in a plurality of terminal housings 22 of a first connector housing 21, a male-type connector 30 in which male-type terminals (not illustrated) are respectively accommodated in a plurality of terminal housings (not illustrated) of a second connector housing 31, and a lever 40 rotatably supported by each support shaft 23 that protrudes at both sides of the first connector housing 21. Further, a hood part 33 of the second connector housing 31 is fitted with or separated from the first connector housing 21 by rotationally operating the lever 40 by engaging cam pins (not illustrated) that protrude on the inner face of the side wall of the hood part 33 of the male-type connector 30 into cam grooves 44 of the lever 40.

The first connector housing 21 is formed of insulating synthetic resin or the like in a block state. At the first connector housing 21, the plurality of terminal housings 22 that accommodate the female-type terminals are formed from the front face 21*a* to the rear face 21*b*. Support shafts 23 that rotatably support the lever 40 are integrally formed to protrude respectively at the rear side of the center of both side faces 21*c*, 21*c* of the first connector housing 21. Each pair of sliding protrusions 24*a*, 24*b* to be inserted into guide grooves 34 of the male-type connector 30 are integrally formed to protrude at the upper and lower ends of the front side of both side faces 21*c*, 21*c* of the first connector housing 21. A stopper 24*c* which restricts rotation of the lever 40 is integrally formed to protrude at the lower end of the rear side of one side face 21*c* of the first connector housing 21.

A connecting bridge 25 of a front U-shape including a pair of side plates 25*a*, 25*a* and a center connecting part 25*b* is integrally formed to protrude at the center of the upper face 21*d* of the first connector housing 21. A flexible lock arm 26 that extends rearward (separating direction of the connector) is integrally formed to protrude at the lower face 25*c* of the center connecting part 25*b*. To describe in detail, the lock arm 26 includes a pair of arm portions 26*b*, 26*b* each extending in a side L-shape from a fixed end 26*a*, and free ends 26*c* of the pair of arm portions 26*b*, 26*b* are connected, then the lock arm 26 is formed in a plan U-shape. The center of the free ends 26*c* of the lock arm 26 constitutes a locking part 27 that engagingly locks with a locking protrusion 47 of the lever 40. Both sides of the locking part 27 constitute release operation parts 28 that release a locking state of the lock arm 26 and the lever 40.

Figure 8A:
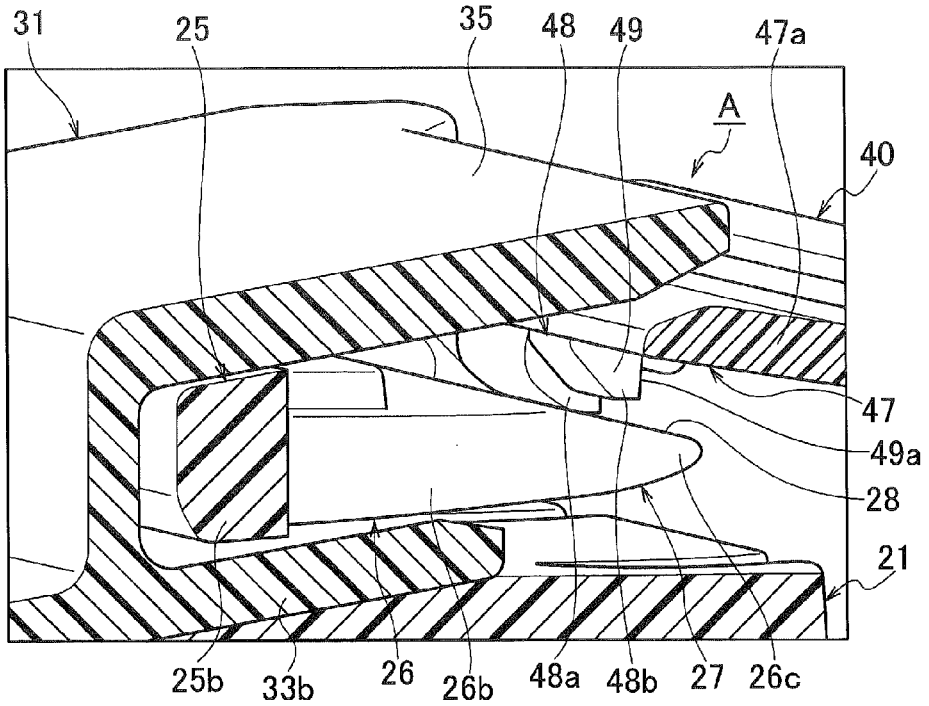
FIG. 8A is a partial perspective view of the lock portion of the lever-type connector according to the embodiment at the initial stage of fitting.
Figure 8B:
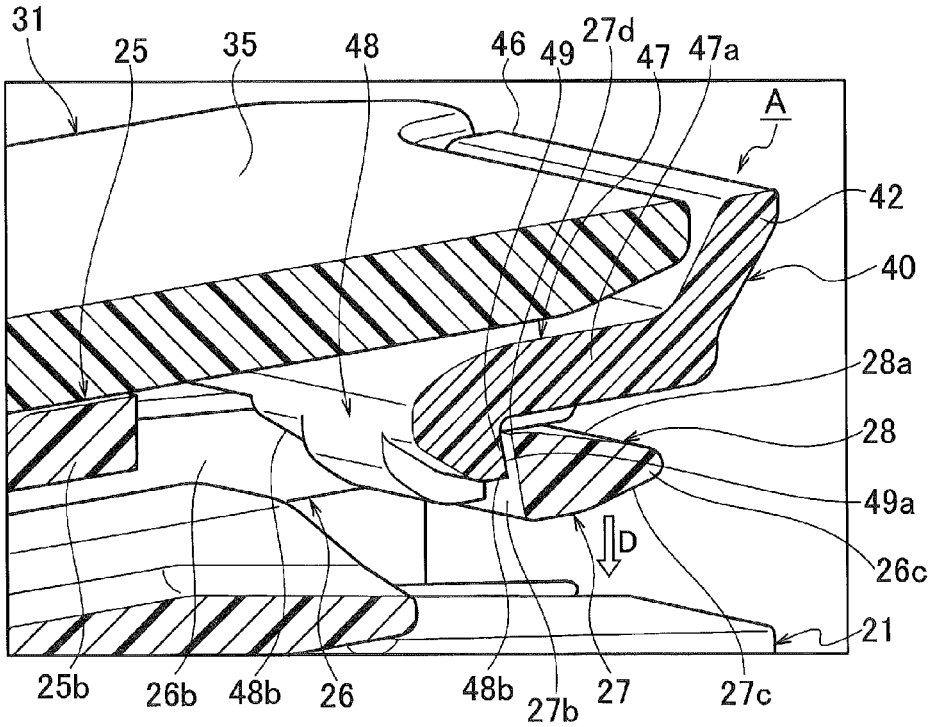
FIG. 8B is a partial perspective view of the lock portion of the lever-type connector according to the embodiment in a fitted state.
Figure 9:
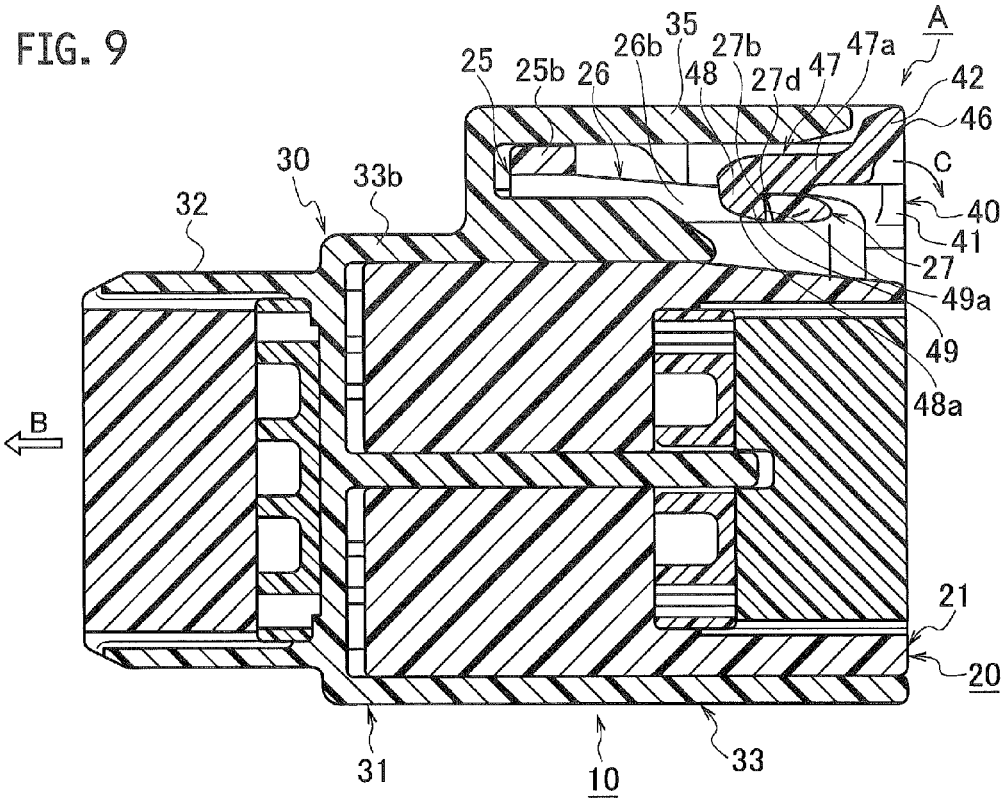
FIG. 9 is a cross-sectional view illustrating a fitted state of the lever-type connector according to the embodiment.
Figure 10:
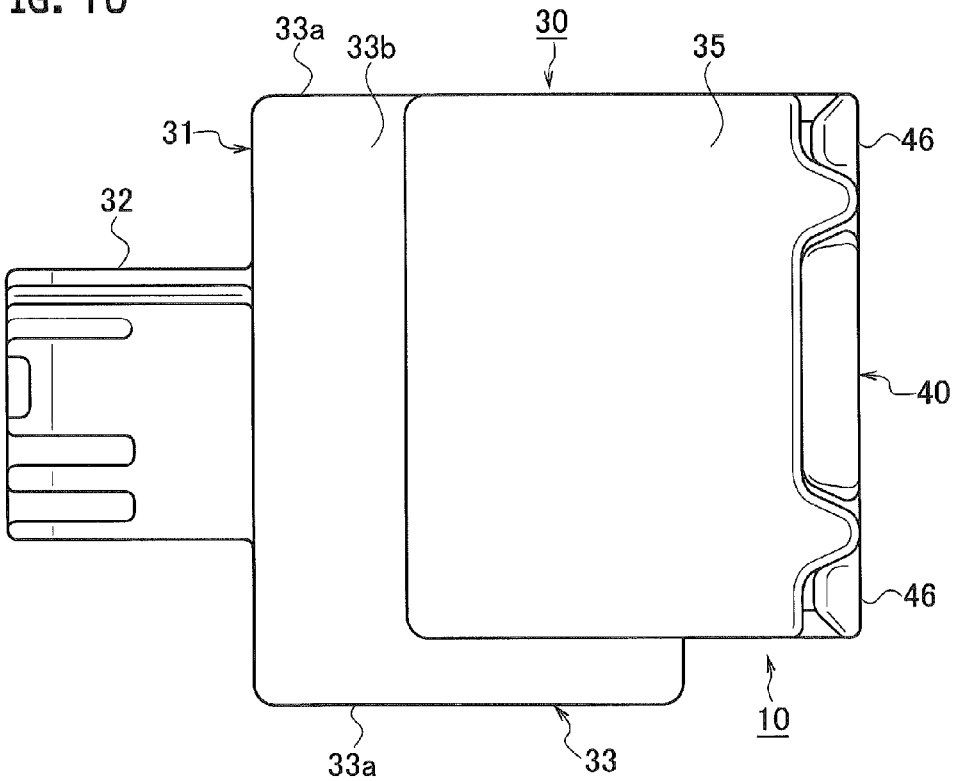
FIG. 10 is a plan view illustrating a fitted state of the lever-type connector according to the embodiment.

As illustrated in FIG. 5, the locking part 27 and a pair of the release operation parts 28 at its both sides are arranged to be adjacent respectively. The locking part 27 is formed in a triangle-pole shape includes a guide slope 27*a* at a front side, a first locking slope 27*b* at a rear side, and a bottom face 27*c*. A rear end part 49 of the locking protrusion 47 is made to be hooked to a rear end 27*d* of the locking part 27 (the corner portion at the boundary of the guide slope 27*a* and the first locking slope 27*b*). The first locking slope 27*b* is inclined so as to act in a direction of more engagingly locking with respect to the rear end part 49 of the locking protrusion 47 of the lever 40. An operating face 28*a* of each of the release operation parts 28 is formed in a non-slip waveform shape. As illustrated in FIGS. 8B and 9, the release operation parts 28 are positioned below an arm portion 47*a* of the locking protrusion 47 at the time of locking of the locking part 27 of the lock arm 26 and the locking protrusion 47 of the lever 40.

The second connector housing 31 is formed of insulating synthetic resin or the like. As illustrated in FIGS. 4 and 6, the second connector housing 31 includes a terminal housing part 32 of a block shape in which a plurality of terminal housings (not illustrated) are formed at the rear side thereof, and the hood part 33 of a quadrangular cylindrical shape at the front side. At each inner face of both side walls 33*a*, 33*a* of the hood part 33, a cam pin (not illustrated) to be engaged with the cam groove 44 of the lever 40 is integrally formed to protrude. At the upper and lower sides of each inner face of both side walls 33*a*, 33*a* of the hood part 33, the guide grooves 34 to which the sliding protrusions 24*a*, 24*b* of the female-type connector 20 are to be inserted are respectively formed. As illustrated in FIGS. 6 to 10, a sub hood part 35 that protrudes upward in a stepped shape is provided at the front side of an upper wall 33*b* of the hood part 33. A lock portion A composed of the lock arm 26 of the female-type connector 20 and the locking protrusion 47 of the lever 40 is accommodated inside the sub hood part 35.

The lever 40 is formed of insulating synthetic resin or the like. As illustrated in FIG. 4, the lever 40 is formed in a substantially U-shape including a pair of left and right side plate parts 41, 41 and a connecting arm part 42 that connects the pair of side plate parts 41, 41. At each side plate part 41, a shaft hole 43 into which the support shaft 23 of the female-type connector 20 is inserted and the cam groove 44 that engages with the cam pin of the male-type connector 30 are formed.

At both sides of the connecting arm part 42, a pair of operation parts 46, 46 that rotatively operate the lever 40 are provided. The side L-shaped and flexible locking protrusion 47 is integrally formed to protrude at the front side of the center of the connecting arm part 42. A distal end 48 of the locking protrusion 47 is made in a hook shape. The bottom face of the distal end 48 is, as illustrated in FIGS. 7B, 8A, and 8B, formed in a stepped shape with a protruding part 48*a* that protrudes at its center and lowered parts 48*b* at both sides of the protruding part 48*a*. The distal end 48 of the locking protrusion 47 is formed to have a size that is inserted within a space formed by the pair of arm portions 26*b* and the free ends 26*c* of the lock arm 26. The protruding part 48*a* at the center of the lower face of the distal end 48 is positioned to face the locking part 27 at the free ends 26*c* of the lock arms 26. The pair of lowered parts 48*b*, 48*b* at both sides of the lower face of the distal end 48 are positioned to face the pair of left and right release operation parts 28, 28 at the free ends 26*c* of the lock arms 26. At the rear end part 49 of the distal end 48, a second locking slope 49*a* which is inclined to act in a direction of more engagingly locking with respect to the locking part 27 of the lock arm 26 is formed.

With the lever-type connector 10 according to the embodiment, in order to fit the female-type connector 20 with the male-type connector 30, first the cam grooves 44 of the lever 40 are engaged with the cam pins of the second connector housing 31 (this state is illustrated in FIG. 6). Next, the operation parts 46 of the lever 40 are pressed to rotate the lever 40 in a direction as illustrated by arrow B in FIGS. 7A and 7B. Then, as illustrated in FIGS. 7B and 8A, the protruding part 48*a* at the center of the bottom face of the distal end 48 of the locking protrusion 47 presses and slides the guide slope 27*a* at the front side of the locking part 27 so as to bend the free ends 26*c* of the lock arms 26 downward. At this time, since the guide slope 27*a* of the locking part 27 against which the protruding part 48*a* at the center of the bottom face of the distal end 48 of the locking protrusion 47 touches is made as a gentle slope, the locking protrusion 47 can be inserted inward smoothly. Moreover, since the release operation parts 28 at both sides of the locking part 27 are positioned at a position of the lowered parts 48*b* at both sides of the protruding part 48*a* at the center of the bottom face of the distal end 48, it is possible to reliably bend the free ends 26*c* of the lock arms 26 downward while avoiding interference with the release operation parts 28.

By press-operating the operation parts 46 of the lever 40 further to rotate the lever 40 further, the male-type connector 30 is drawn to the female-type connector 20 side with low insertion force by the principle of leverage, and as illustrated in FIG. 9, the first connector housing 21 of the female-type connector 20 and the hood part 33 of the male-type connector 30 are fitted. This fitting state is locked by engagingly locking the locking part 27 of the lock arm 26 of the female-type connector 20 accommodated within the sub hood part 35 of the male-type connector 30 with the locking protrusion 47 of the lever 40, as illustrated in FIGS. 8B and 9. At this time, the distal end 48 of the locking protrusion 47 is inserted within the space formed by the arm portions 26*b* and the free ends 26*c*, and the rear end 27*d* of the locking part 27 of the lock arm 26 is engagingly locked to the rear end part 49 of the distal end 48 of the locking protrusion 47 such that it is hooked. Therefore, the locking state of the locking protrusion 47 and the locking part 27 is reliably retained and the locking is hardly disengaged.

Moreover, it was made such that, as illustrated in FIG. 5, the release operation parts 28 are arranged at both sides of the locking part 27 that is locked to the rear end part 49 of the locking protrusion 47, and the locking part 27 and the release operation parts 28 are arranged to be adjacent on the side of the free ends 26*c*, and further, as illustrated in FIG. 9, at the time of fitting of the female-type connector 20 and the male-type connector 30, the lock portion A composed of the locking part 27 and the locking protrusion 47 can be accommodated within the sub hood part 35 of the male-type connector 30. Therefore, simplification and miniaturization of the lock portion A can be achieved even further and it can be made to have a structure in which the locking is hardly disengaged.

Furthermore, even when tensile force of electric wires connected to the plurality of male terminals (force in a separating direction as illustrated by arrow B of FIG. 9) is applied to the male-type connector 30, it is structured such that the rear end 27*d* of the locking part 27 is locked to the rear end part 49 of the distal end 48 of the locking protrusion 47 by being hooked. Moreover, the second locking slope 49*a* which is inclined to act in a direction of more engagingly locking is formed at the rear end part 49 of the locking protrusion 47, and the first locking slope 27*b* which is inclined so as to act in a direction of more engagingly locking is formed at the rear end 27*d* side of the locking part 27. Therefore, the second locking slope 49*a* of the rear end part 49 of the locking protrusion 47 and the first locking slope 27*b* of the rear end 27*d* of the locking part 27 act in a direction of more engagingly locking with each other, and locking between the locking part 27 of the lock arm 26 and the locking protrusion 47 of the lever 40 becomes even harder to be disengaged. Thus, it is possible to simply and reliably prevent locking of the lock portion A from coming off.

Furthermore, as illustrated in FIGS. 8B and 9, the release operation parts 28 are provided to be positioned below the arm portion 47*a* of the locking protrusion 47 at the time of locking between the locking part 27 of the lock arm 26 and the locking protrusion 47 of the lever 40. Therefore, unlike the conventional lever-type connector, the release operation parts 28 are not exposed outside and the locking does not become released by the release operation parts 28 being unexpectedly operated. Since the locking does not become released unexpectedly as such, it is possible to enhance locking retention of the lock portion A even further.

Moreover, the fixed end 26*a* of the lock arm 26 is arranged on the lower face 25*c* side of the center connecting part 25*b* of the front U-shaped connecting bridge 25. In other words, the connecting bridge 25 is provided on the opposite side of the flexible direction (the free ends 26*c*) of the lock arm 26. Thus, even if the operation parts 46 of the lever 40 are forcibly pulled toward a lock releasing direction (direction as illustrated by arrow C in FIG. 9), biting between the locking part 27 of the lock arm 26 and the locking protrusion 47 of the lever 40 becomes larger and it is possible to reliably prevent disengagement of the locking.

Figure 7A:
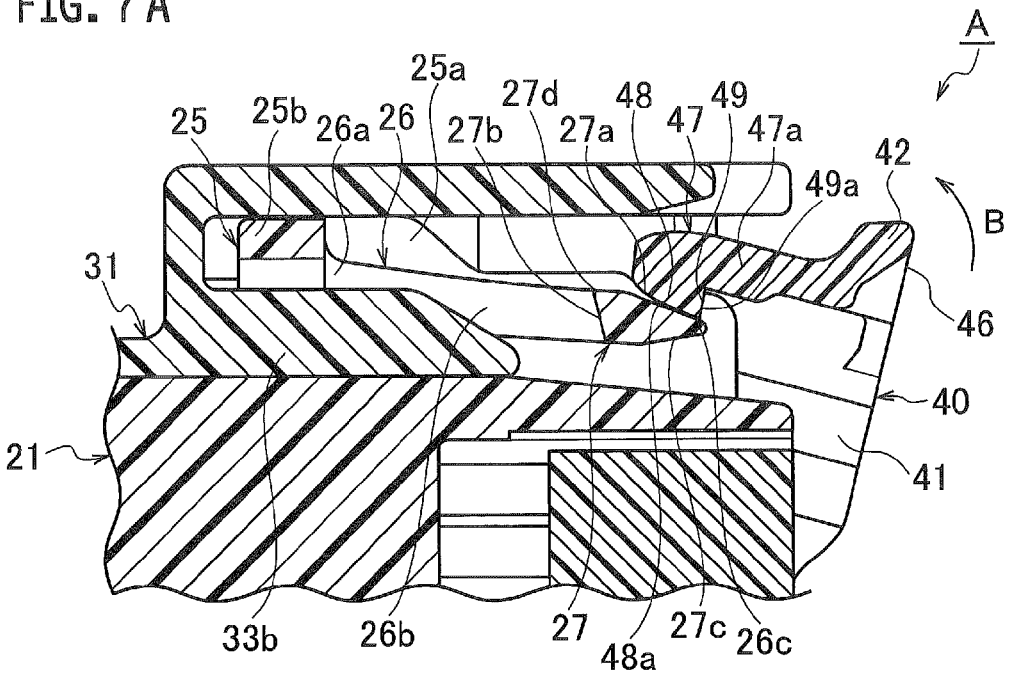
FIG. 7A is a partial cross-sectional view of a lock portion of the lever-type connector according to the embodiment at the initial stage of fitting.
Figure 7B:
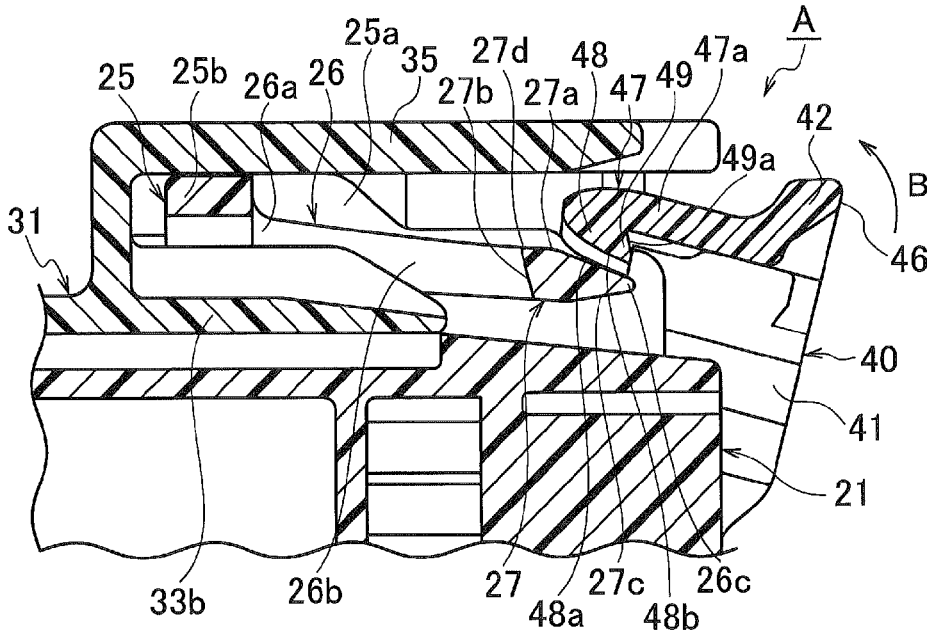
FIG. 7B is a partial cross-sectional view of the lock portion of the lever-type connector according to the embodiment in the middle of fitting.

Further, to release the fitting state between the female-type connector 20 and the male-type connector 30, by press-operating the release operation parts 28 provided at both sides of the locking part 27 of the lock arm 26 downward (direction as illustrated by arrow D in FIG. 8B), the locking state of the locking part 27 of the lock arm 26 and the locking protrusion 47 of the lever 40 is released, and thereafter, the first connector housing 21 of the female-type connector 20 and the hood part 33 of the male-type connector 30 can be separated with low insertion force by pressing to rotate the operation parts 46 of the lever 40 toward an opposite direction from the arrow B illustrated in FIGS. 7A and 7B.

Furthermore, while in the lever-type connector 10 according to the embodiment, the lever 40 having the cam grooves 44 was provided on the first connector housing 21 of the female-type connector 20, it can also be made such that the lever 40 is provided on the second connector housing 31 of the male-type connector 30 and the cam pins are provided on the first connector housing 21 of the female-type connector 20.

What is claimed is:

1. A lever-type connector, comprising:

a first connector housing;

a second connector housing;

a lever which is rotatably provided on the first connector housing and which can fit or separate the first connector housing and the second connector housing by a rotating operation;

a flexible lock arm provided on the first connector housing and extending in a fitting direction of the first connector housing to the second connector housing;

a locking protrusion provided on the lever;

a locking part which is provided on a free end side of the flexible lock arm and whose rear end side is capable of locking so as to be hooked to a rear end part of the locking protrusion; and a release operation part provided adjacent to the locking part and positioned below the lever at a time of locking the locking part with the locking protrusion, the release operation part being capable of releasing a locking state of the rear end part of the locking protrusion and the rear end side of the locking part; and a connecting bridge of a front U-shape provided on a fixed end side of the flexible lock arm, wherein the flexible lock arm is provided to extend in a side L-shape and in a plan U-shape from a lower face of a center connecting part of the connecting bridge, the locking part is provided at a center on the free end side of the flexible lock arm, and the release operation part is provided to be adjacent to both sides of the locking part.

2. The lever-type connector according to claim 1, further comprising:

a first locking slope which is formed on the rear end side of the locking part and which is inclined so as to act in a direction of locking; and a second locking slope which is formed on the rear end part of the locking protrusion and which is inclined so as to act in a direction of locking.

3. The lever-type connector according to claim 1, wherein the first connector housing and the second connector housing are formed of insulating synthetic resin in a block state.

4. The lever-type connector according to claim 1, wherein the first connector housing comprises a plurality of terminal housings formed from a front face of the first connector housing to a rear face of the first connector housing, and the plurality of terminal housings is configured to accommodate female-type terminals.

5. The lever-type connector according to claim 1, wherein the lever is rotatably provided on the first connector housing and is rotatably supported by support shafts.

6. The lever-type connector according to claim 5, wherein the support shafts are integrally formed to protrude respectively at a rear side of a center of both side faces of the first connector housing.

7. The lever-type connector according to claim 1, wherein the first connector housing is provided with pairs of sliding protrusions to be inserted into guide grooves of the second connector housing.

8. The lever-type connector according to claim 7, wherein each of the pairs of sliding protrusions are integrally formed to protrude at upper and lower ends of a front side of both side faces of the first connector housing.

9. The lever-type connector according to claim 1, wherein the first connector housing is provided with a stopper that protrudes at a lower end of a rear side of one side face of the first connector housing, the stopper configured to restrict a rotation of the lever.

10. The lever-type connector according to claim 1, wherein the connecting bridge comprises a pair of side plates and the center connecting part that protrudes at a center of an upper face of the first connector housing.

11. The lever-type connector according to claim 1, wherein the flexible lock arm extends rearward in a separating direction of the connector, and the flexible lock arm protrudes at the lower face of the center connecting part.

12. The lever-type connector according to claim 1, wherein the locking part is formed in a triangle-pole shape including a guide slope at a front side, a first locking slope at a rear side, and a bottom face.

13. The lever-type connector according to claim 1, wherein an opening face of the release operation part comprises a non-slip waveform shape.

14. The lever-type connector according to claim 1, wherein the release operation part is positioned below an arm portion of the locking protrusion at the time of locking of the locking part of the flexible lock arm and the locking protrusion of the lever.

15. The lever-type connector according to claim 1, wherein the lever comprises a substantially U-shape including a pair of left and right side plate parts and a connecting arm part that connects the pair of side plate parts.

16. The lever-type connector according to claim 15, wherein each side plate part is provided with a shaft hole into which a support shaft of the first connector housing is inserted and a cam groove that engages with a cam pin of the second connector housing.

17. The lever-type connector according to claim 15, wherein a pair of operation parts that rotatively operate the lever are provided at both sides of the connecting arm parts.

18. The lever-type connector according to claim 15, wherein the locking protrusion has a side L-shaped and protrudes at a front side of a center of the connecting arm part.

19. The lever-type connector according to claim 1, wherein the second connector housing comprises a hood part having a quadrangular cylindrical shape at a front side of the second connector housing, a sub hood part that protrudes upward in a stepped shape is provided at a front side of an upper wall of the hood part, and a lock portion composed of the flexible lock arm and the locking protrusion is accommodated inside the sub hood part.

* * * * *